US011274430B2

(12) United States Patent
Scilley

(10) Patent No.: US 11,274,430 B2
(45) Date of Patent: Mar. 15, 2022

(54) BUILDING STRUCTURE AND METHOD OF CONSTRUCTION

(71) Applicant: Joel Scilley, New Orleans, LA (US)

(72) Inventor: Joel Scilley, New Orleans, LA (US)

( * ) Notice: Subject to any disclaimer, the term of this patent is extended or adjusted under 35 U.S.C. 154(b) by 0 days.

(21) Appl. No.: 16/899,866

(22) Filed: Jun. 12, 2020

(65) Prior Publication Data

US 2021/0388602 A1 Dec. 16, 2021

(51) Int. Cl.

| | |
|---|---|
| ***E04B 1/343*** | (2006.01) |
| ***E04B 2/70*** | (2006.01) |
| ***E04B 7/02*** | (2006.01) |
| ***E04B 5/12*** | (2006.01) |
| ***E04H 1/12*** | (2006.01) |

(52) U.S. Cl.

CPC ..... *E04B 1/34352* (2013.01); *E04B 1/34384* (2013.01); *E04B 2/70* (2013.01); *E04B 5/12* (2013.01); *E04B 7/022* (2013.01); *E04B 2001/34389* (2013.01); *E04H 1/1205* (2013.01); *E04H 2001/1283* (2013.01)

(58) Field of Classification Search

CPC ..... E04B 1/34352; E04B 5/12; E04B 2/70; E04B 7/022; E04B 1/34384; E04B 2001/34389; E04H 1/1205; E04H 2001/1283

See application file for complete search history.

(56) References Cited

U.S. PATENT DOCUMENTS

| | | | | |
|---|---|---|---|---|
| 4,075,814 | A * | 2/1978 | Theurer | E04B 1/34823 52/143 |
| 4,854,094 | A * | 8/1989 | Clark | E04B 1/3483 52/79.1 |
| 5,950,373 | A * | 9/1999 | von Hoff | E04H 1/1205 52/79.5 |
| 6,463,705 | B1 * | 10/2002 | Davis | E04B 1/343 52/143 |
| 7,827,738 | B2 * | 11/2010 | Abrams | E04B 1/348 52/79.1 |
| 8,001,730 | B2 * | 8/2011 | Wallance | E04H 1/005 52/79.1 |
| 8,186,110 | B2 * | 5/2012 | Green | E04B 1/34807 52/79.9 |
| 8,397,441 | B2 * | 3/2013 | Wallance | E04H 1/005 52/79.1 |
| 8,826,600 | B2 * | 9/2014 | Wallance | F24D 3/145 52/79.1 |
| 9,115,504 | B2 * | 8/2015 | Wallance | E04H 1/04 |
| 9,279,265 | B1 * | 3/2016 | Nead | E04H 9/10 |

(Continued)

*Primary Examiner* — Rodney Mintz

(74) *Attorney, Agent, or Firm* — The Ella Project; Mark Melasky

(57) ABSTRACT

A modular building structure that utilizes a standard, unmodified intermodal shipping container both for transport of the structural components and as an integral element of the method of construction. A modular structure kit is enclosed in the shipping container, which can be transported using all means that are standard for ISO containers. Using the preferred method of construction, the shipping container can be situated without heavy equipment. Once situated, the shipping container provides the primary support for a permanent elevated structure composed of unique components, assembled using conventional building techniques without the necessary use of heavy or specialized equipment.

14 Claims, 13 Drawing Sheets

(56) References Cited

U.S. PATENT DOCUMENTS

| | | | | |
|---|---|---|---|---|
| 9,920,512 | B1 * | 3/2018 | Eisold | E04H 1/04 |
| 10,260,228 | B2 * | 4/2019 | King | E04H 1/02 |
| 10,584,503 | B2 * | 3/2020 | Fan | E04C 2/521 |
| 10,633,877 | B2 * | 4/2020 | Wolff | E04B 1/34321 |
| 10,745,930 | B2 * | 8/2020 | Newman | H01Q 1/1235 |
| 10,837,168 | B2 * | 11/2020 | Rittmanic | E04B 1/34321 |
| 10,851,552 | B1 * | 12/2020 | DeMatteis | E04H 1/1205 |
| 10,920,414 | B2 * | 2/2021 | Gordon | E04H 1/005 |
| 2009/0000213 | A1 * | 1/2009 | Coopman | E04H 1/1205 52/79.5 |
| 2009/0223144 | A1 * | 9/2009 | Leahy | E04B 1/34321 52/79.1 |
| 2010/0018131 | A1 * | 1/2010 | Green | E04B 1/34807 52/79.5 |
| 2018/0079589 | A1 * | 3/2018 | Meister | E04B 1/34321 |
| 2018/0163391 | A1 * | 6/2018 | King | E04H 1/02 |
| 2018/0274254 | A1 * | 9/2018 | Fan | E04H 1/04 |
| 2018/0274258 | A1 * | 9/2018 | Newman | H01Q 1/10 |
| 2019/0292770 | A1 * | 9/2019 | Gordon | E04B 1/34321 |
| 2019/0376303 | A1 * | 12/2019 | Wolff | E02D 27/02 |
| 2020/0040565 | A1 * | 2/2020 | Viehweg | E04B 1/34331 |
| 2020/0291637 | A1 * | 9/2020 | Rittmanic | E04B 1/34352 |
| 2020/0399917 | A1 * | 12/2020 | McDonald | E04H 1/1205 |

* cited by examiner

BUILDING STRUCTURE AND METHOD OF CONSTRUCTION

BACKGROUND OF THE INVENTION

1. Field of the Invention

The present invention relates to a transportable structure kit most often referred to as a modular or kit home. While this invention is described in the context of such homes, it has broader application and is not limited to this particular use.

2. Prior Art

Modular or kit homes are those that utilize pre-fabricated components generally assembled off site, which are then transported to a site and assembled. Relative to standard forms of residential construction, modular or kit homes hold the promise of being less expensive, and easier and quicker to assemble on site. However, much of the promise of this type of home has yet to be realized: modular homes are often as costly as standard constructions and they often require specialized machinery and/or expertise that reduce the efficiency of construction. Many of these structures are also relatively difficult to transport to site.

Relatedly, shipping containers have many advantages as a kind of "raw material" for the construction of homes. They are, of course, easily transported, but also quite strong, inexpensive (in their unmodified form), resistant to weather, stackable, etc. For these reasons, shipping containers have become popular as the primary components of modular home designs. However, while their dimensions and solidity are optimal for their primary use as transport containers, these traits are, in many ways, less than optimal for use as habitation without major modification to their structure. Additionally, their use for habitation often requires heavy machinery for positioning or for performing structural modifications. Consequently, shipping container homes are often difficult to design and build, and frequently just as costly as conventional structures.

Many efforts have been made to utilize the general form of the ISO shipping container for transportable modular homes or buildings. These efforts generally aim to provide inexpensive, easy-to-assemble structures, whether for temporary or permanent placement. These inventions attempt to address the shortcomings of both shipping container homes and modular or kit homes in general. However, these inventions generally feature (highly) modified versions of the general form of the shipping container rather than utilizing the strengths of unmodified containers. And in certain cases shipping containers are used for transport only, rather than being integral to the final structure.

Most relevant, U.S. Pat. No. 5,950,373 describes a modular/kit home structure that is transportable in the general form of shipping container. Rather than using an unmodified ISO container, this invention utilizes a unique construction that is preferably but not necessarily compatible with normal transportation methods associated with unmodified ISO containers. This invention also utilizes a specialized foundation and uses the walls and other portions of the container as parts of the primary structure.

U.S. Pat. No. 9,920,512 B1 describes a two level structure using a modified container in the general form of a shipping container. The container used in this invention is a highly-modified version of a container with a telescopic method of forming a second level of the structure. Also, this invention does not necessarily comply with ISO standards for intermodal shipping containers and therefore might require specialized modes of transport.

U.S. Pat. No. 9,115,504 B2 describes a variety of structures and methods of construction utilizing convertible containers transportable in accordance with ISO intermodal standards. However, the final structures are comprised of the steel components that form the walls, ceilings, etc. of the shippable containers, and the method of construction is specific to the design of the component-based containers, rather than being conventional.

U.S. Pat. No. 4,075,814 describes a modular housing invention that utilizes prefabricated housing components that can be shipped inside standard ISO containers. This invention uses the ISO containers for transport only, not as part of the resultant structures.

BRIEF SUMMARY OF THE INVENTION

In accordance with embodiments of the invention, a modular building kit is included. The modular building kit is operable to be delivered to a building site and contains within a single shipping container the materials needed for construction of a modular building. Materials included in the modular building kit are the shipping container itself, prefabricated floor joist panels, prefabricated floor sheathing, prefabricated wall sheathing, prefabricated wall panels, prefabricated roof rafters, prefabricated roof sheathing, and foundation posts.

In accordance with embodiments of the invention, a modular building is provided. The modular building includes a shipping container that is shipped containing the materials needed for construction of the modular building and is placed in a permanent position at a construction site. A plurality of foundation posts are secured in a perimeter surrounding the shipping container. A plurality of floor joist panels are positioned on top of the shipping container and on top of the plurality of foundation posts. The plurality of floor joist panels form a second story floor. Floor sheathing is attached to the top surface of the plurality of floor joist panels. A plurality of wall panels are attached around a periphery of the floor joist panels and form an enclosure. Wall sheathing is attached to the outer perimeter of the plurality of wall panels. A plurality of roof rafters are positioned on top of the enclosure formed by the plurality of wall panels. Roof sheathing is attached to the top of the roof rafters, fully enclosing the structure.

In one embodiment, the modular building includes a kit for building a kitchen. In another embodiment, the modular building kit includes a kit for building a bathroom. In another embodiment, the modular building kit includes a kit for constructing a plurality of windows. In another embodiment, the modular building kit includes a kit for constructing a staircase. In another embodiment, the modular building kit includes a kit for constructing a ramp. In another embodiment, the modular building kit includes a kit for constructing a plurality of doors.

In accordance with embodiments of the invention, a method for building a structure is provided. The method includes a first step (a) delivering a modular building kit to a construction site, the modular building kit comprising, a shipping container containing a plurality of foundation posts, a plurality of floor joist panels, a plurality of wall panels, a floor sheathing, and a wall sheathing, and a plurality of roof rafters. The method includes a second step (b) of positioning the shipping container via mechanical or manual lifts to a permanent location. The method includes a third step (c) of positioning the plurality of foundation posts offset from the sides of the shipping containers and the foundation posts are operable to support a periphery of the floor joist panels. The method includes a fourth step (d) of positioning said plurality of floor joist panels on top of the shipping container and foundation posts and the floor joist panels form an upper floor. The method includes a step (e) of attaching the floor sheathing to the top of the floor joists. The method includes a step (f) of attaching the plurality of wall panels around a periphery of the floor joists and the plurality of wall panels form an enclosure. The method includes a step (g) of attaching the wall sheathing to the outer perimeter of the wall panels. The method includes a step (h) of positioning the plurality of roof rafters on top of the enclosure formed by the plurality of wall panels. The method includes a step (i) of attaching the roof sheathing to the top of the roof rafters.

In one embodiment, the method for building a modular structure includes a preceding step of preparing a foundation upon which the shipping container is placed.

In one embodiment, the method for building a modular structure includes a step intervening between steps (f) and (g), during which plumbing connections are installed into the modular structure.

BRIEF DESCRIPTION OF THE DRAWINGS

The foregoing and other objects, features, and advantages of the invention are apparent from the following detailed description taken in conjunction with the accompanying drawings in which like parts are given like reference numerals and, wherein.

Figure 1:
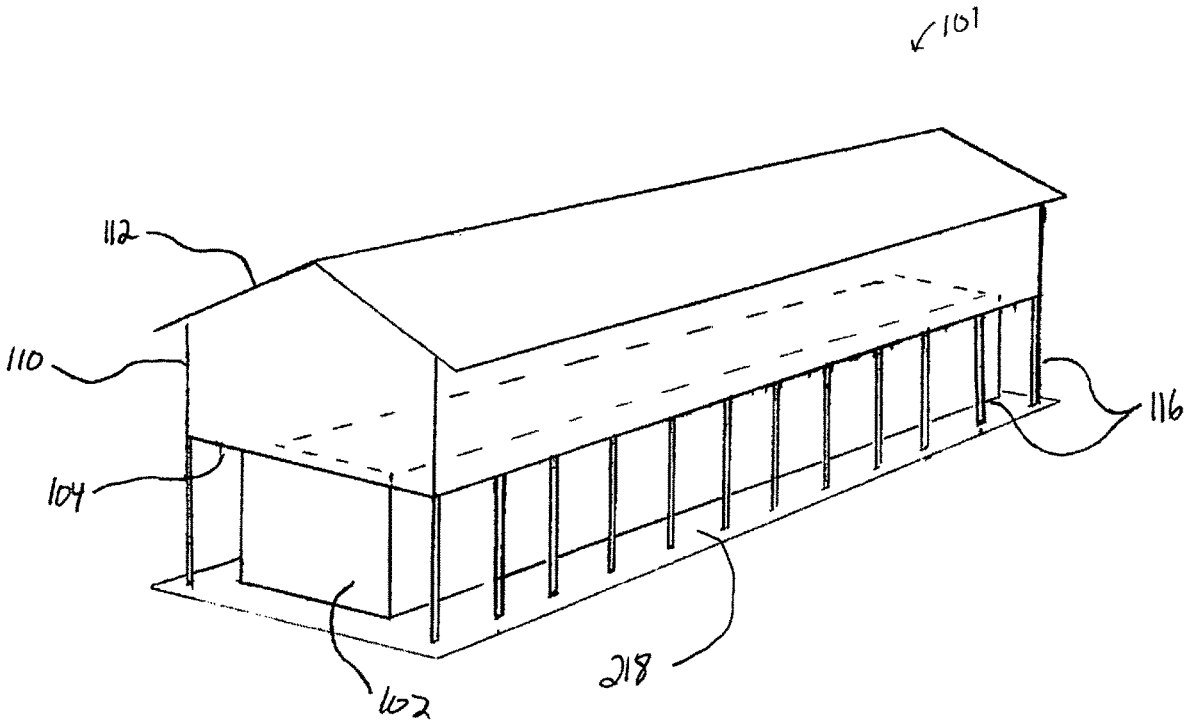
FIG. 1 is a schematic perspective view of one embodiment of the invention illustrating a modular home positioned above an ISO container and a slab-type foundation.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION OF THE INVENTION

The embodiments of the disclosure will be best understood by reference to the drawings, wherein like parts are designated by like numerals throughout. It will be readily understood that the components, as generally described and illustrated in the Figures herein, could be arranged and designed in a wide variety of different configurations or be entirely separate. Thus, the following more detailed description of the embodiments of the system and method of the disclosure, as represented in the Figures is not intended to limit the scope of the disclosure, as claimed, but is merely representative of possible embodiments of the disclosure.

The invention described here is a modular or kit home and a preferred method of assembly or construction. The included drawings and descriptions of its preferred embodiments are not meant to exclude other embodiments that might fall under the scope of this invention. For instance, the drawings represent a structure with a plurality of elements that are comprised of various forms of standard dimensional lumber common in residential construction. However, this invention also imagines the use of other materials, such as conventional steel framing or even 3 dimensional printed components. And while the drawings and descriptions of this one embodiment describe a singular modular home, the scope of the invention is not limited to that embodiment, but includes groupings of similar structures or uses other than as a home.

Similarly, the preferred method of assembly described here does not exclude other methods that might fall within the scope of this invention. For instance, while the present description includes two possible foundation types compatible with the proposed structure and method, other forms of foundation might similarly meet the structural and methodological needs of this invention and fall within its scope.

In accordance with embodiments of the invention, a modular building kit 100 is included, as illustrated in FIGS. 1-13. The modular building kit 100 is operable to be delivered to a building site and contains all materials needed for construction of a modular building 101 within a single shipping container 102. Materials included in the modular building kit are the shipping container 102, prefabricated floor joist panels 104, prefabricated floor sheathing 106

(commonly referred to as subfloor), prefabricated wall sheathing 108, prefabricated wall panels 110, prefabricated roof rafters 112, prefabricated roof sheathing 114, and foundation posts 116.

Figure 12:
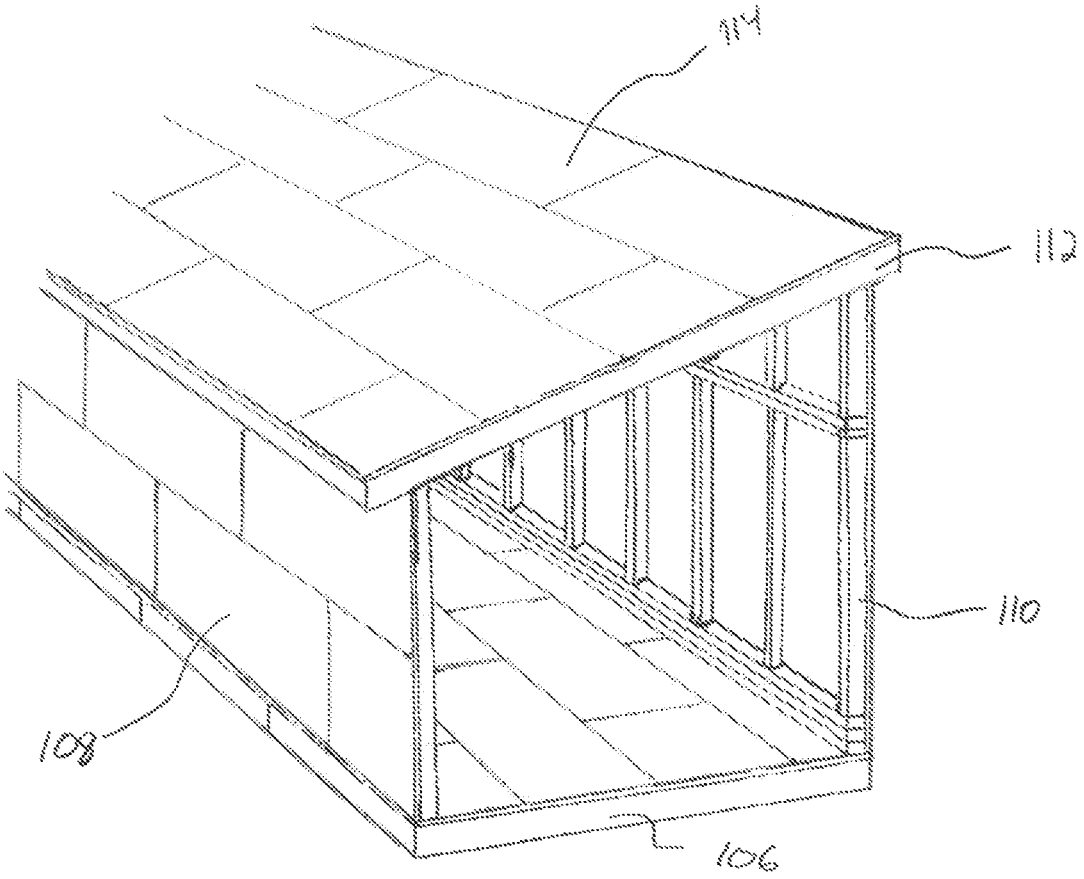
FIG. 12 is a schematic perspective view of one embodiment of the invention illustrating a modular home in accordance with embodiments of the invention

In accordance with embodiments of the invention, a modular building 101 is provided. The modular building 101 includes a shipping container 102 that is shipped containing all materials needed for construction of the modular building 101 and is placed in a permanent position at a construction site. A plurality of foundation posts 116 are secured in a perimeter surrounding the shipping container 102. A plurality of floor joist panels 104 are positioned on top of the shipping container 102 and on top of the plurality of foundation posts 116. The plurality of floor joist panels 104 form a second story floor. Floor sheathing 106 is attached to the top surface of the plurality of floor joist panels 104. A plurality of wall panels 208 are attached around a periphery of the floor joist panels 104 and form an enclosure. Wall sheathing 108 is attached to the outer perimeter of the plurality of wall panels 110. A plurality of roof rafters 112 are positioned on top of the enclosure formed by the plurality of wall panels 110. Roof sheathing 114 is attached to the top surface of the roof rafters 112, fully enclosing the structure, as illustrated in FIGS. 1 and 12.

Figure 13:
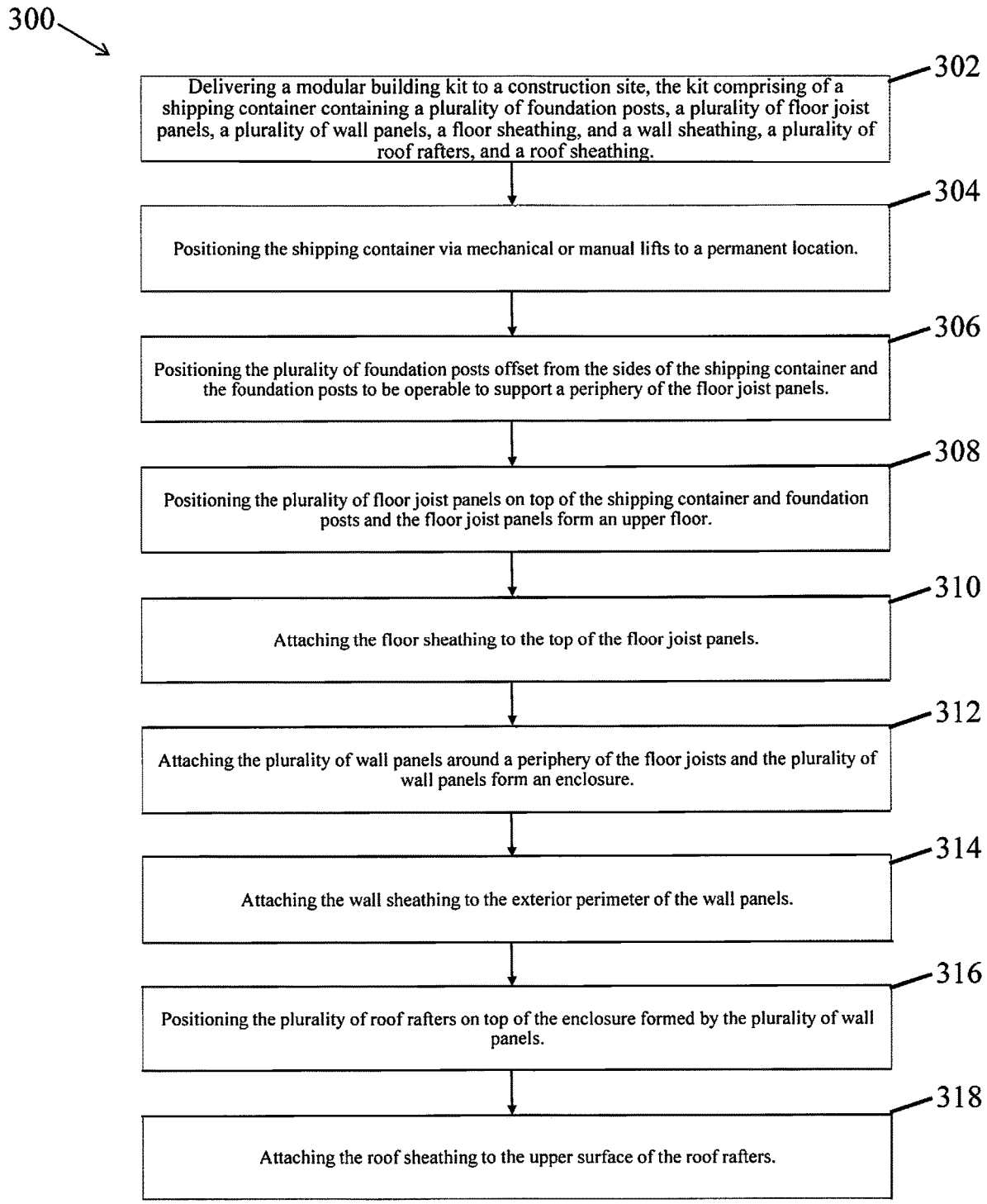
FIG. 13 is a flow chart illustrating a method of building a structure in accordance with embodiments of the invention.

In accordance with embodiments of the invention, as illustrated in FIG. 13, a method 300 for building a modular structure 101 is provided. The method includes a first step (a) 302 delivering a modular building kit 100 to a construction site, the modular building kit 100 comprising, a shipping container 102 containing a plurality of foundation posts 116, a plurality of floor joist panels 104, a plurality of wall panels 110, a floor sheathing 106, and a wall sheathing 108, a plurality of roof rafters 112, and a roof sheathing 114. The method includes a second step (b) 304 of positioning the shipping container 102 via mechanical or manual lifts to a permanent location. The method includes a third step (c) 306 of positioning the plurality of foundation posts 116 offset from the sides of the shipping container 102 and the foundation posts 116 are operable to support a periphery of the floor joist panels 104. The method includes a fourth step (d) 308 of positioning said plurality of floor joist panels 104 on top of the shipping container 102 and foundation posts 116 and the floor joist panels 104 form an upper floor. The method includes a step (e) 310 of attaching the floor sheathing 106 to the top of the floor joist panels 104. The method includes a step (f) 312 of attaching the plurality of wall panels 110 around a periphery of the floor joists 104 and the plurality of wall panels 110 form an enclosure. The method includes a step (g) 314 of attaching the wall sheathing 108 to the outer perimeter of the wall panels 110. The method includes a step (h) 316 of positioning the plurality of roof rafters 112 on top of the enclosure formed by the plurality of wall panels 110. The method includes a step (i) 318 of attaching the roof sheathing 114 to the top of the roof rafters 112.

In one embodiment, as illustrated in FIG. 1, the drawing depicts a modular structure 101 formed from a plurality of prefabricated components including floor joist panels 104, wall panels 110, and roof rafters 112.

FIG. 1 further depicts construction of the modular structure above a standard ISO intermodal shipping container 102. The ISO container 102 is a component part of the overall structure insofar as it provides the primary support for the remainder of the modular structure 101 assembled above it. Additionally, FIG. 1 shows a series of load-bearing foundation posts 116 that attach to perimeter rim joists (or perimeter framing of other sorts, if constructed of material other than wood) along the two length sides of the modular structure 101. These foundation posts 116 are cut to finished length on site, and secured at their bottoms to concrete foundation(s) 218, 226 as described in FIGS. 2 and 3 and together with the ISO container 102, form the permanent foundation for the modular structure 101.

FIG. 1 further depicts how the foundational posts 116 are positioned such that they function as load-bearing members of the foundation 218, but they are also spaced to allow for easy attachment of sheathing and/or siding, and to allow for the use of manually operated container jacks, which may be used to lower the container 102 into its position on site. During the assembly of the structure 101, manually operated container jacks may be positioned at the four corners of the container, providing the spacing of foundation post anchors 220 proximal to the four corners of the structure as to not interfere with the use of jacks. Thus, the space between the four corner posts 224 and the nearest posts 116 along the length side of the structure should be sufficient to allow the positioning of container jacks. The placement of these foundational posts 116 is part of the invention claimed here, as the use of manual container jacks eliminates the need for the use of heavy machinery for positioning the shipping container 102 on site, thereby reducing costs and complications in the process of construction.

Figure 2:
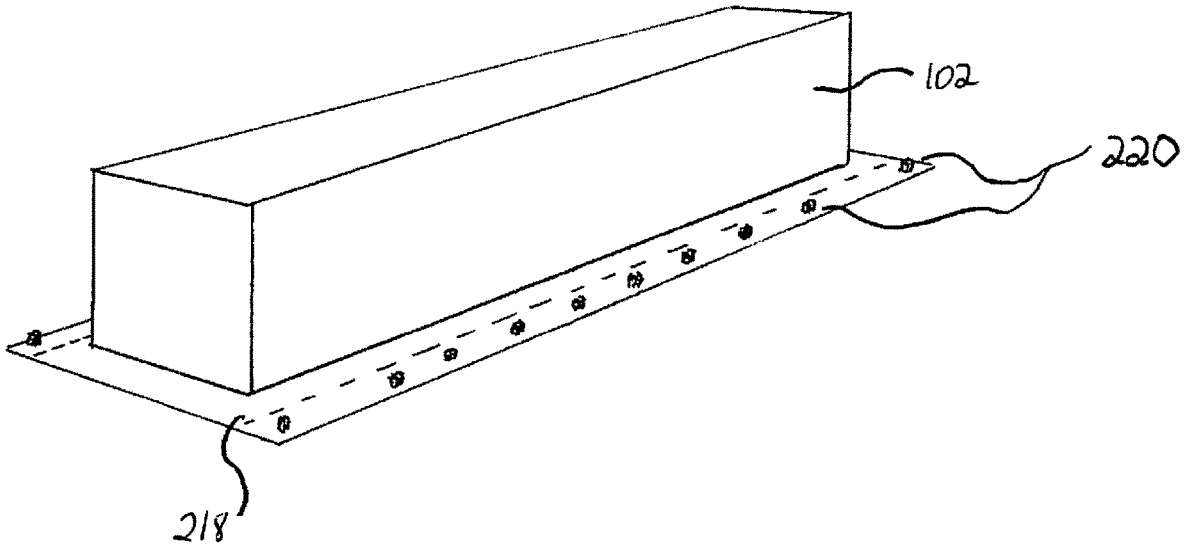
FIG. 2 is a schematic perspective view of one form of slab foundation in accordance with embodiments of the invention.

In one embodiment, as illustrated in FIG. 2, the drawing depicts a preferred foundation design and the position of the ISO container 102 on that foundation 218. This foundation 218 is of a common concrete slab type, its unique feature consisting of the spacing of foundation post anchors 220. As in FIG. 1, the spacing of the anchors 220 positioned along the length sides of the foundation 218, particularly the spacing between the four corner anchors and their nearest anchors, is sufficient to allow the use of manual container jacks without obstruction. The preferred method of construction of this foundation 218 consists of two stages: the central portion of the foundation 218 in FIG. 2 is constructed in advance of the transport of the shipping container 102 to the site, while the portion of the foundation 218 on the length sides, including the post anchors 220, is constructed once the load-bearing posts 116 are attached to the floor joist panels 206 and 240.

Figure 3:
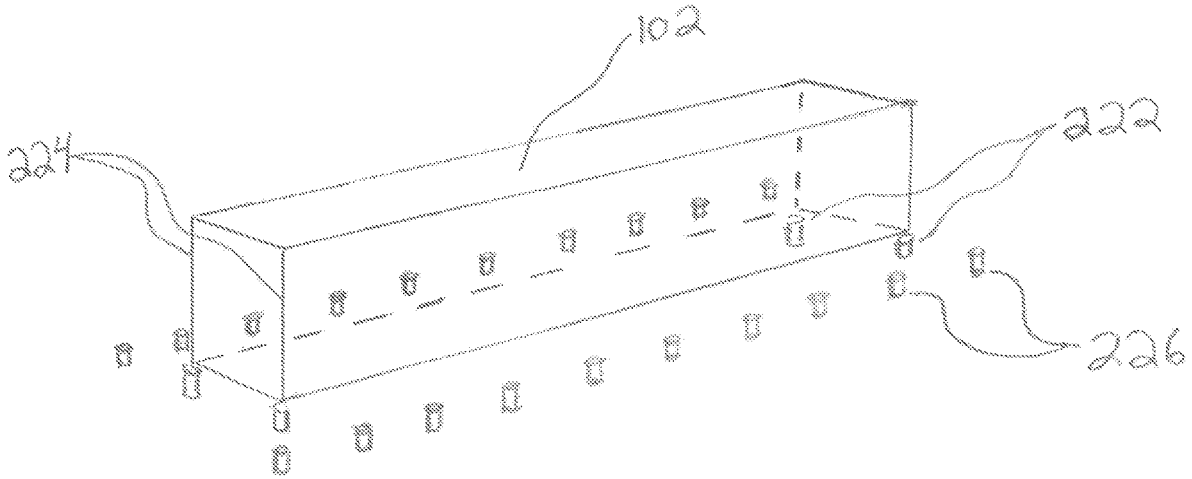
FIG. 3 is a schematic perspective view of one alternative form of pier foundation in accordance with embodiments of the invention.

In one embodiment, as illustrated in FIG. 3, the drawing depicts an alternative preferred foundation along with its position relative to the shipping container 102. This foundation 222 is of a concrete pier type. The preferred method of construction of this foundation consists of two stages, one prior to transport of the shipping container 102 to site, and one following the placement of the container 102 on site and partial construction of the modular home.

Prior to the onsite placement of the shipping container 102, four concrete piers 222 are constructed that correspond with the locations of the four corner posts 224 of the container 102. These piers are to be of a type and size sufficient to support the combined weight of the container 102 and the completed modular structure 101.

Figure 6:
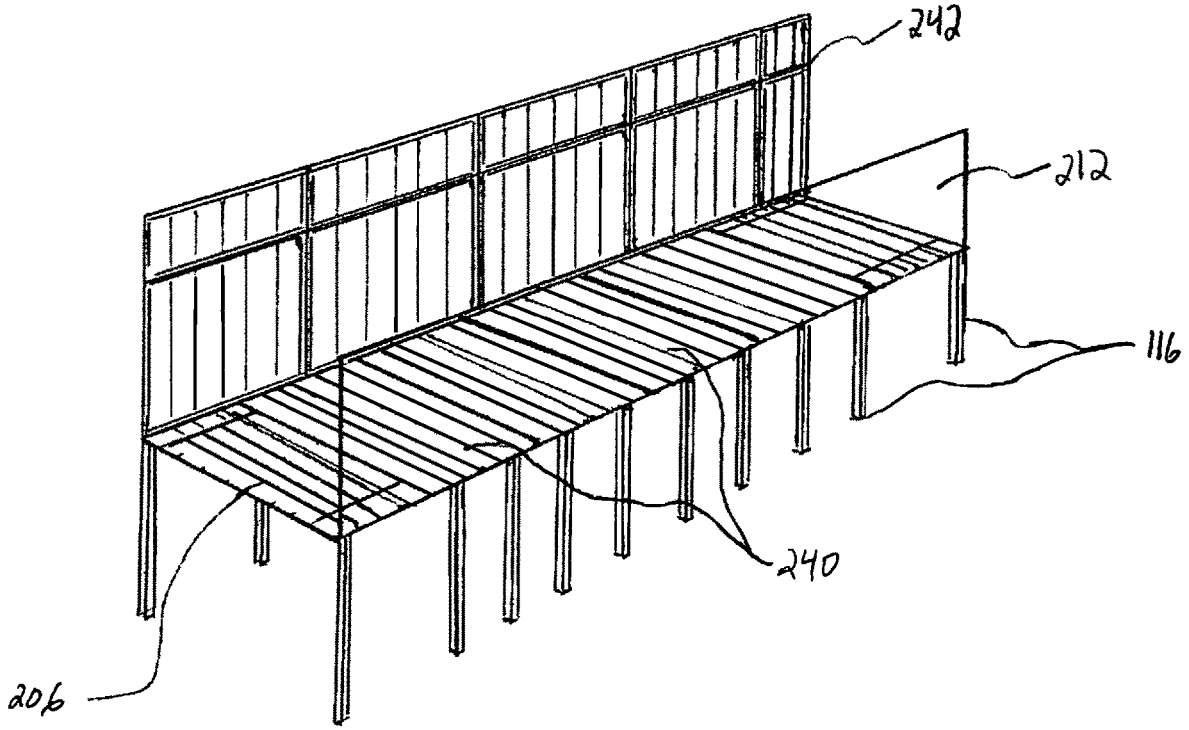
FIG. 6 is a schematic perspective showing the floor joist panels and wall panels of the type that exceed nominal 8' walls according to this invention in accordance with embodiments of the invention.
Figure 9:
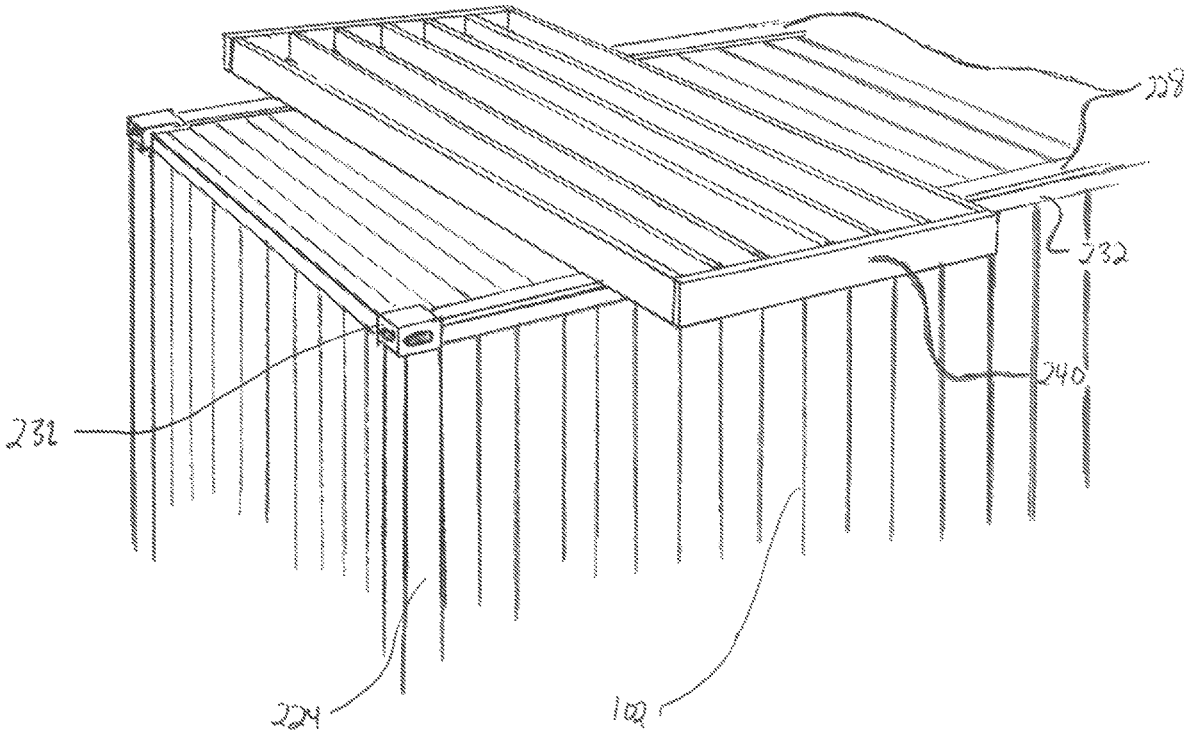
FIG. 9 is a schematic perspective of the preferred framing technique for one form of floor joist panel in accordance with embodiments of the invention.

Following placement of the shipping container 102 on the foundation piers 222 and the assembly of the floor joist panels 240 in FIGS. 6 and 9, piers are constructed supporting foundation posts 204. The preferred method for this construction is to attach the posts 204 to the floor joist panels 240 and then construct their corresponding piers 226 with the posts 204 in place. This method is the most efficient and cost-effective form of post installation.

Figure 4:
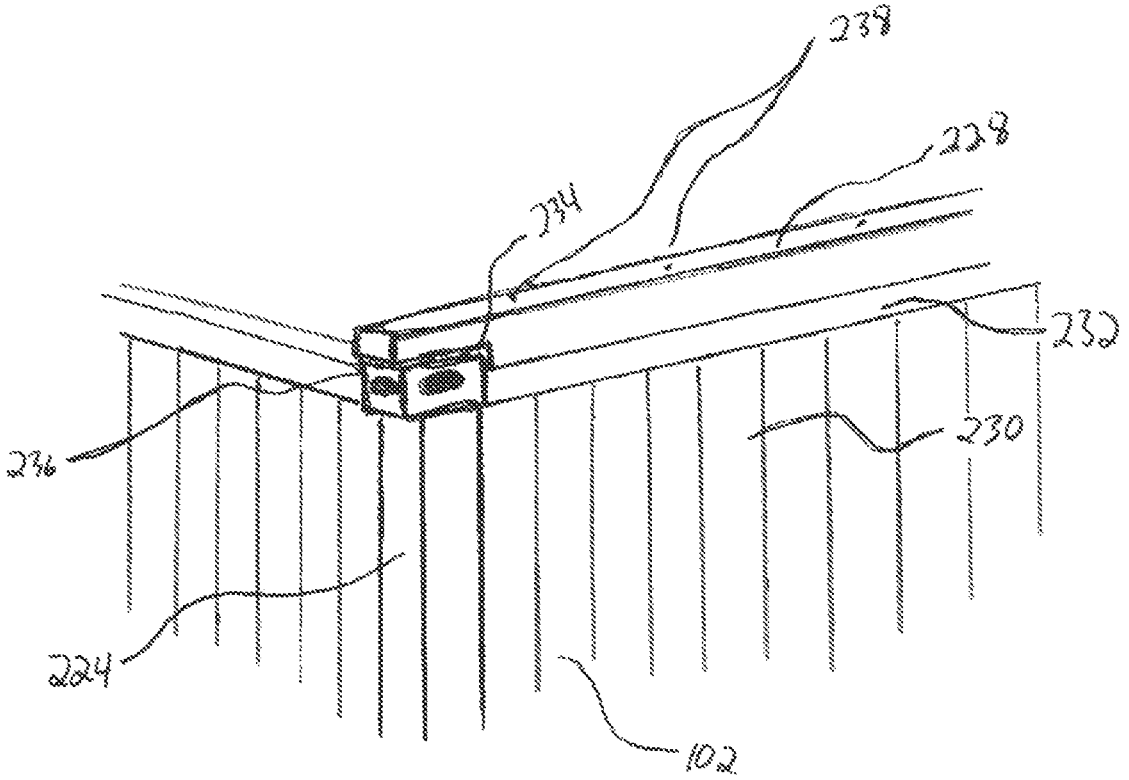
FIG. 4 is a detail perspective of the corner of an ISO shipping container with attached sill to make container sides level with corner lugs in accordance with embodiments of the invention.

In one embodiment, as illustrated in FIG. 4, the drawing depicts the preferred means of creating a level surface on top of the shipping container 102 to allow for the assembly of the floor joist panels 206, 240. As the corner posts 224 of shipping containers are slightly higher than the side walls of the containers 230, sills 228 are fixed on site to the top rails 232 of the side walls 230 and feature cut notches 234 above the post corner fittings 236. The sills 228 extend the full length of both sides of the container 230 and allow the attachment of floor joist panels 240 using standard construction fasteners. The sills 228 are fastened to the top rails 232 of the container sides 230 using steel bolts or screws 238.

Figure 5:
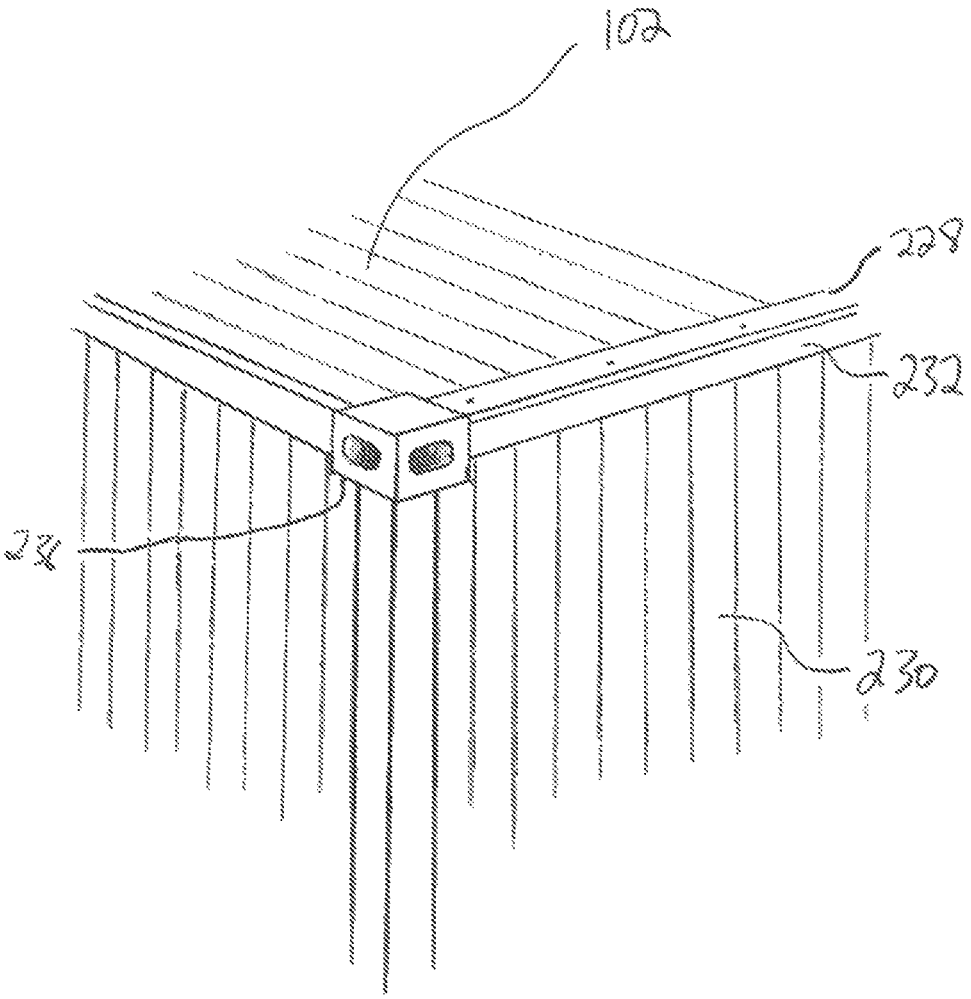
FIG. 5 is a detail perspective of a corner of an ISO shipping container with an alternative type of attached sill to make container sides level with corner lugs in accordance with embodiments of the invention.

In one embodiment, as illustrated in FIG. 5, the drawing depicts another preferred method of creating a level surface on top of the shipping container 102. In this example, sills 228 are attached with steel bolts or screws 238 to the top rails 232 of the side walls 230, flush with the tops of the post corner fittings 236.

The sills described here are constructed with dimensional lumber, however other materials or means that result in a level surface on both sides of the container fall under the scope of this invention. These sills are to be assembled following the placement of the shipping container 102, and prior to the placement of the floor joist panels 240.

In one embodiment, as illustrated in FIG. 6, the drawing depicts the preferred assembly of the floor joist panels 206, 240 and the assembly of nominal 8' wall panels 212 and wall panels higher than 8' 242 in one configuration of the modular structure. The floor joist panels 240 are pre-fabricated and sized to fit within the interior dimensions of the shipping container 102, and are assembled on top of, and attached to the sills 228. Following the attachment of foundation posts 116 to the joist panels 240, a standard subfloor can be installed and wall panels 212, 242 can be installed above the subfloor. The floor joist panels 240 extend beyond the footprint of the container 102 on all sides in a cantilevered fashion until the foundation posts 116 are constructed.

Figure 7:
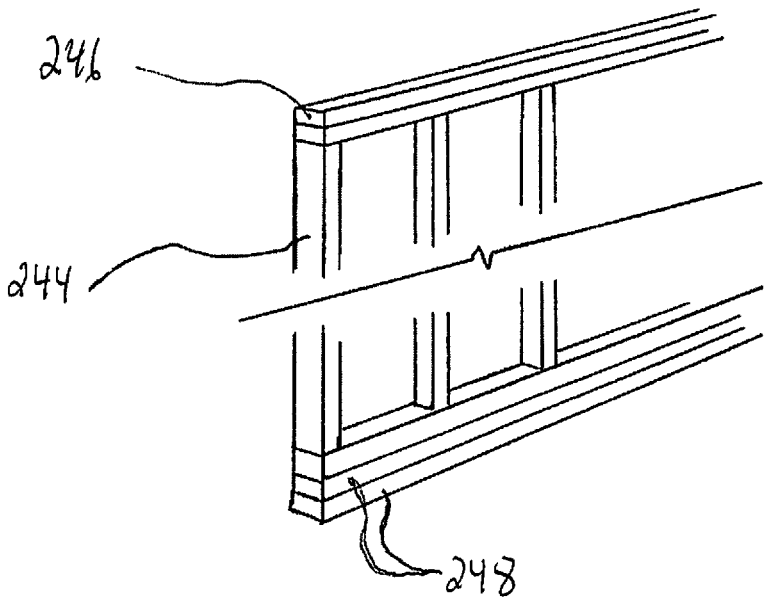
FIG. 7 is a perspective showing the preferred framing technique for nominal 8' walls in accordance with embodiments of the invention.

In one embodiment, as illustrated in FIG. 7, the drawing depicts a preferred framing method of a load bearing nominal 8' wall panel 212. This wall panel partially consists of a 92⅝" tall prefabricated wall structure with single top and bottom plates 244, that is transportable inside the shipping container 102. On site, an additional top plate 246 and two additional bottom plates 248 are attached, forming a wall panel 97⅛" in height (a residential construction standard). A series of these panels can then be joined to form perimeter or other walls.

Figure 8:
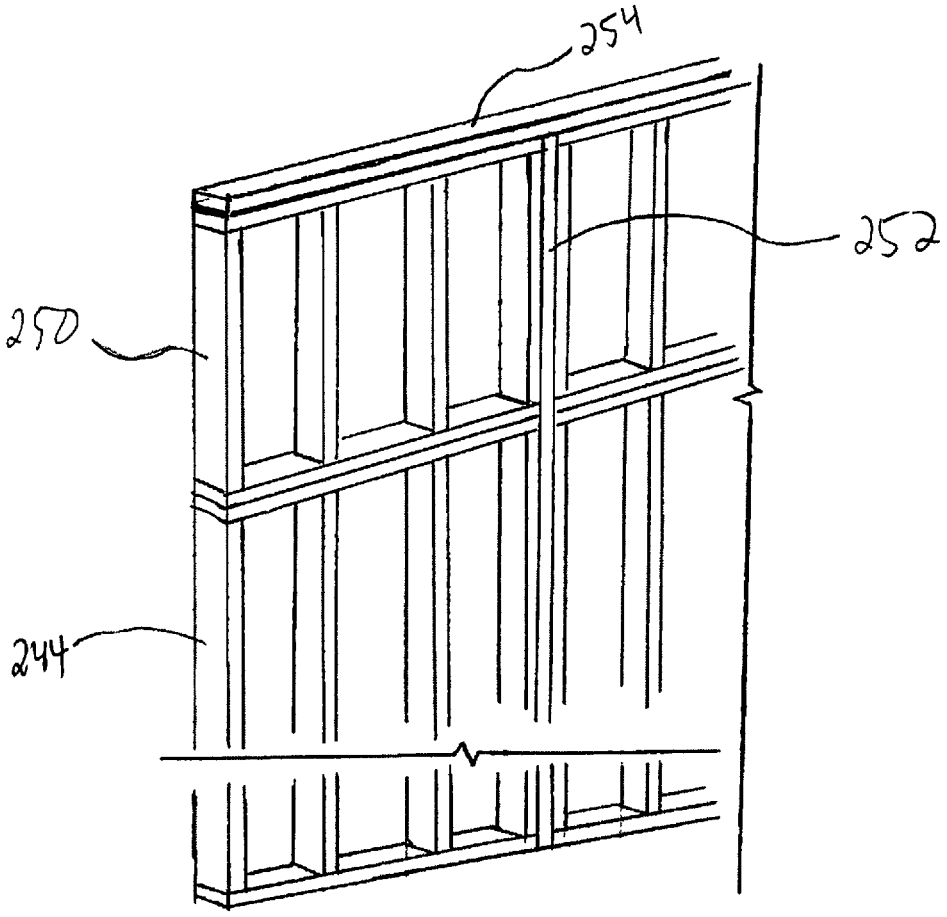
FIG. 8 is a detail perspective showing the preferred framing technique for walls that exceed 8' in height, in accordance with embodiments of the invention.

In one embodiment, as illustrated in FIG. 8, the drawing depicts a preferred framing method of a load bearing wall higher than 8' 242. A 92⅛" wall structure 244 can be attached to a secondary wall structure consisting of studs and a single top and bottom plate 250. A series of these structures can then be assembled with continuous studs 252 along their length and with one additional top plate 254. This method of assembly allows all the individual components to be transported within the shipping container 102, and results in a rigid wall structure that is easily and quickly assembled on site.

In one embodiment, as illustrated in FIG. 9, the drawing depicts a preferred method of construction of one form of floor joist panel 240 and its position relative to the shipping container 102. Floor joist panels 240 are constructed of sizes to allow transport within the shipping container 102. After positioning of the container on site and the attachment of the sills 228 as in FIGS. 4 and 5, the floor joist panels 240 are fastened to the sills 228 such that they are partially cantilevered beyond the sides of the container.

Figure 10:
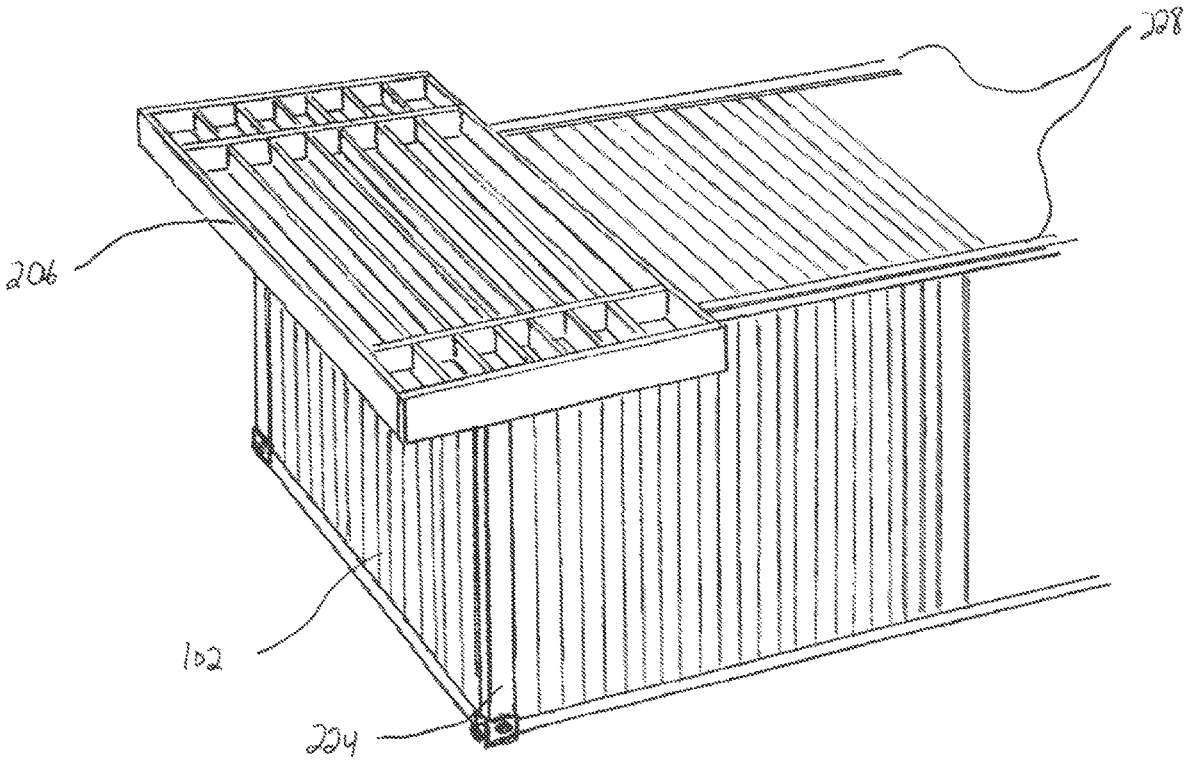
FIG. 10 is a schematic perspective of the preferred framing technique for a second form of floor joist panel in accordance with embodiments of the invention.

In one embodiment, as illustrated in FIG. 10, the drawing depicts a preferred method of construction of another form of floor joist panel 206 and its position relative to the shipping container 102. As with floor joist panel 240, these panels are constructed to allow transport within the shipping container 102. They are similarly pre-fabricated, and when attached to the sills 228 they cantilever beyond both the sides and both ends of the shipping container 102.

Joist panels 206 and 240 are represented here as constructions of conventional dimensional lumber that can be quickly attached to the container 102 and sills 228 using conventional fasteners. The key features of these panels relative to this invention are dimensions that allow for transport within the shipping container 102, and their ability to essentially expand the footprint of the modular home beyond the dimensions of the shipping container. While the preferred methods of construction presented here are likely the most cost-effective, other framing methods and materials can be used to the same ends and would still fall within the scope of this invention.

Figure 11:
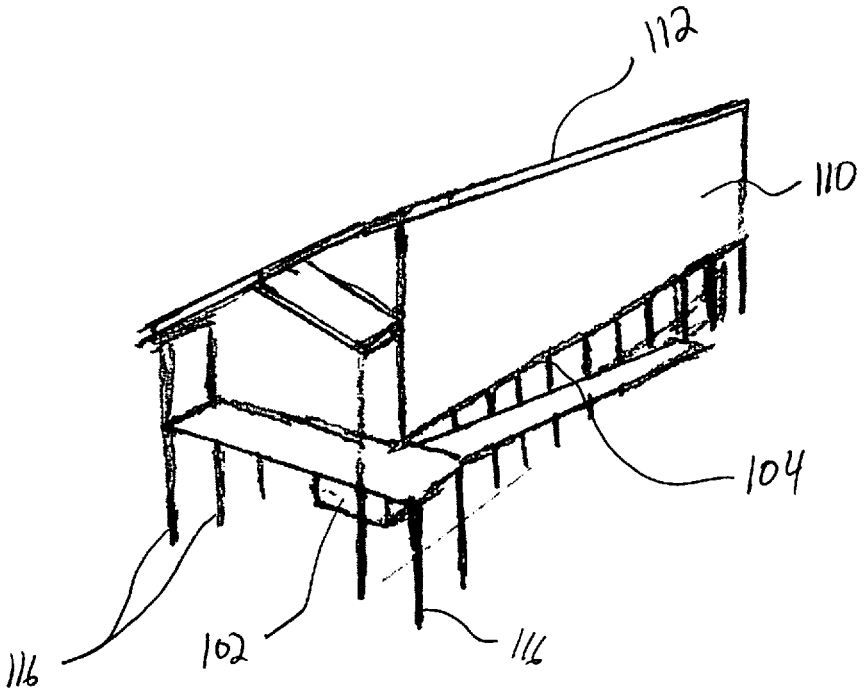
FIG. 11 is a schematic perspective view of one embodiment of the invention illustrating a modular home positioned above an ISO container and a slab-type foundation in accordance with embodiments of the invention.

In one embodiment, as illustrated in FIG. 11, the drawing depicts a complete modular structure 101.

In one embodiment, the present invention includes a permanent structure 101 and method of construction 300 aimed at minimizing the costs and complexity of construction and transport through the use of a modular construction kit and the use of a standard ISO intermodal shipping container.

In one embodiment, the structure is fabricated of components that are prefabricated off site and then transported to a permanent site inside the shipping container. Each of the components of the structure are designed to fit within the interior ISO dimensions of the container and when assembled they form the primary habitable structure. In this method, the ISO container functions not only for transport, but as a part of the foundation that supports the modular structure above it.

In one embodiment, the prefabricated modular structure kit is comprised of sills which provide for a level building surface on the roof of the shipping container, floor joist panels, floor and wall sheathing, wall panels, rafters and foundation posts, that when assembled according to the present method, form the principal structure of a home or other building. This structure is intended for either individual use or in combination with other similar structures, as either a home or for other uses, though it is primarily envisaged as housing.

Preferably, the ISO container is to be loaded with the modular kit off site and then relocated using any of the forms of transport associated with ISO intermodal standards, terminating with transport via standard flat or tilt bed truck. Preferably, the permanent site for the structure will be prepared with one of the present, relatively conventional concrete foundation designs. Once on site, the container is preferably offloaded using manual lifts or other means. The modular kit can then be assembled, using conventional techniques and tools, in the order of the method described herein, forming a two level, permanent structure with the container positioned below the modular home structure.

The component parts of the home kit, while all designed to fit within the ISO container, are variously configurable and can be produced with varying dimensions to provide for the construction of a variety of different structural forms. So, while certain forms are represented here, they do not represent the full range of possible structures that can result from the method of transport and construction described by this invention.

In one embodiment, the building kit 100 includes floor joist panels, floor sheathing, wall sheathing, wall panels, roof rafters, roof sheathing, and foundation posts which are prefabricated to fit within a standard 40 foot shipping container. In this embodiment, the kit 100 can be used to construct a building with approximately a 585 sq/ft interior and a footprint of 14 feet×44 feet. In this embodiment, the kit 100 would contain six floor joist panels of 84 inches×168 inches, one floor joist panel of 24 inches×168 inches, six wall panels of 92⅝ inch height×160 inch width, two wall panels 92⅝ inch height×43½ inch width, and two end wall panels of 92⅝ inch height×161 inch width. Depending upon the configuration of the roof, the kit 100 may include additional prefabricated wall panels used to construct one or more walls higher than the nominal 8 foot wall. All of the components of this kit 100 are designed to fit within the interior dimensions of the standard 40 foot shipping container (94 inch height×93 inch width×474 inch length) for transport.

The invention claimed is:

1. A method for building a structure comprising:

(a) delivering a modular building kit to a construction site, the modular building kit comprising:
- a shipping container;
- a plurality of foundation posts;
- a plurality of floor joist panels, wherein the plurality of floor joist panels is comprised of six floor joist panels each having first dimensions and one floor joist panel having second dimensions;
- a plurality of wall panels, wherein the plurality of wall panels is comprised of six wall panels each having third dimensions, two wall panels each having fourth dimensions and two end wall panels each having fifth dimensions;
- a floor sheathing;
- a wall sheathing;
- a plurality of roof rafters; and
- a roof sheathing;

(b) positioning the shipping container on a permanent location;

(c) positioning the plurality of foundation posts offset from sides of the shipping container, said foundation posts configured to support a periphery of the floor joist panels;

(d) positioning said plurality of floor joist panels on top of the shipping container and foundation posts, said floor joist panels forming an upper floor;

(e) attaching said floor sheathing to a top surface of the floor joist panels;

(f) attaching said plurality of wall panels around the periphery of the floor joist panels, said plurality of wall panels forming an enclosure;

(g) attaching said wall sheathing to an outer perimeter of the wall panels;

(h) positioning said plurality of roof rafters on top of the enclosure formed by the plurality of wall panels; and (i) attaching said roof sheathing to a top surface of the roof rafters.

2. The method of claim 1, wherein the permanent location is a foundation, and wherein the modular kit is delivered to and positioned upon the foundation.

3. The method of claim 1, wherein a plumbing connection is installed between steps f and g.

4. The method of claim 1, wherein the shipping container is positioned via mechanical or manual lifts.

5. The method of claim 1, wherein the plurality of foundation posts, the plurality of floor joist panels, the plurality of wall panels, the floor sheathing, the wall sheathing, the plurality of roof rafters, and the roof sheathing fit within the shipping container.

6. The method of claim 5, wherein the shipping container is a standard ISO 40 foot shipping container.

7. The method of claim 6, wherein the first dimensions are 84 inches×168 inches and the second dimensions are 24 inches×168 inches; wherein the third dimensions are 92⅝ inch height×160 inch width, the fourth dimensions are 92⅝ inch height×43½ inch width, and the fifth dimensions are 92⅝ inch height×161 inch width; and wherein each foundation post of the plurality of foundation posts is less than 40 feet in length.

8. A method for building a structure comprising:

(a) delivering a modular building kit to a construction site, said modular building kit comprising:
- a shipping container;
- a plurality of foundation posts, said plurality of foundation posts contained within the shipping container;
- a plurality of floor joist panels, said plurality of floor joist panels contained within the shipping container, wherein the plurality of floor joist panels is comprised of six floor joist panels each having first dimensions and one floor joist panel having second dimensions;
- a plurality of wall panels, said plurality of wall panels contained within the shipping container, wherein the plurality of wall panels is comprised of six wall panels each having third dimensions, two wall panels each having fourth dimensions and two end wall panels each having fifth dimensions;
- a floor sheathing, said floor sheathing contained within the shipping container;
- a wall sheathing, said wall sheathing contained within the shipping container;
- a plurality of roof rafters, said plurality of roof rafters contained within the shipping container; and
- a roof sheathing, said roof sheathing contained within the shipping container;

(b) positioning the shipping container on a permanent location;

(c) positioning the plurality of foundation posts offset from sides of the shipping container, said foundation posts configured to support a periphery of the floor joist panels;

(d) positioning said plurality of floor joist panels on top of the shipping container and foundation posts, said floor joist panels forming an upper floor;

(e) attaching said floor sheathing to a top surface of the floor joist panels;

(f) attaching said plurality of wall panels around the periphery of the floor joist panels, said plurality of wall panels forming an enclosure;

(g) attaching said wall sheathing to an outer perimeter of the wall panels;

(h) positioning said plurality of roof rafters on top of the enclosure formed by the plurality of wall panels; and (i) attaching said roof sheathing to a top surface of the roof rafters.

9. The method of claim 8, wherein the shipping container is a standard ISO shipping container.

10. The method of claim 8, wherein the shipping container is a standard ISO 40 foot shipping container.

11. The method of claim 10, wherein the first dimensions are 84 inches×168 inches and the second dimensions are 24 inches×168 inches; wherein the third dimensions are 92⅝ inch height×160 inch width, the fourth dimensions are 92⅝ inch height×43½ inch width, and the fifth dimensions are 92⅝ inch height×161 inch width; and wherein each foundation post of the plurality of foundation posts is less than 40 feet in length.

12. A method for building a structure comprising:

(a) delivering a shipping container to a construction site, said shipping container containing a plurality of foundation posts, a plurality of floor joist panels, a plurality of wall panels, a floor sheathing, a wall sheathing, a plurality of roof rafters, and a roof sheathing;

(b) positioning the shipping container on a permanent location;

(c) positioning the plurality of foundation posts offset from sides of the shipping container, said foundation posts configured to support a periphery of the floor joist panels;

(d) positioning said plurality of floor joist panels on top of the shipping container and foundation posts, said floor joist panels forming an upper floor;

(e) attaching said floor sheathing to a top surface of the floor joist panels;

(f) attaching said plurality of wall panels around the periphery of the floor joist panels, said plurality of wall panels forming an enclosure;

(g) attaching said wall sheathing to an outer perimeter of the wall panels;

(h) positioning said plurality of roof rafters on top of the enclosure formed by the plurality of wall panels; and (i) attaching said roof sheathing to a top surface of the roof rafters;

wherein the plurality of floor joist panels is comprised of six floor joist panels each having first dimensions and one floor joist panel having second dimensions, and wherein the plurality of wall panels is comprised of six wall panels each having third dimensions, two wall panels each having fourth dimensions and two end wall panels each having fifth dimensions.

13. The method of claim 12, wherein the shipping container is a standard ISO 40 foot shipping container.

14. The method of claim 13, wherein the first dimensions are 84 inches×168 inches and the second dimensions are 24 inches×168 inches; wherein the third dimensions are 92⅝ inch height×160 inch width, the fourth dimensions are 92⅝ inch height×43½ inch width, and the fifth dimensions are 92⅝ inch height×161 inch width; and wherein each foundation post of the plurality of foundation posts is less than 40 feet in length.

* * * * *